US007882855B2

(12) United States Patent
Henke

(10) Patent No.: US 7,882,855 B2
(45) Date of Patent: Feb. 8, 2011

(54) AIR FLOW PATH FOR AN AIR IMPINGEMENT FINGER DUCT

(75) Inventor: Mitchell C. Henke, Fort Wayne, IN (US)

(73) Assignee: Lincoln Foodservice Products, LLC, Fort Wayne, IN (US)

( * ) Notice: Subject to any disclaimer, the term of this patent is extended or adjusted under 35 U.S.C. 154(b) by 0 days.

(21) Appl. No.: 11/899,604

(22) Filed: Sep. 5, 2007

(65) Prior Publication Data

US 2008/0085673 A1 Apr. 10, 2008

Related U.S. Application Data

(60) Provisional application No. 60/842,244, filed on Sep. 5, 2006.

(51) Int. Cl.
*F15D 1/02* (2006.01)

(52) U.S. Cl. ..... 138/39; 138/37; 126/15 A; 126/61; 126/72

(58) Field of Classification Search ..... 138/37, 138/39; 126/15 A, 61, 72
See application file for complete search history.

(56) References Cited

U.S. PATENT DOCUMENTS 2,564,334 A * 8/1951 Kennedy ..... 454/293
3,051,073 A * 8/1962 Kennedy ..... 454/293
3,548,735 A * 12/1970 Sweeney et al. ..... 454/297
3,597,166 A * 8/1971 Hochman ..... 422/220
3,673,946 A * 7/1972 Ragland ..... 454/303
3,884,213 A 5/1975 Smith ..... 126/21 A
4,066,011 A 1/1978 Ballentine ..... 99/467
4,153,044 A 5/1979 Nett ..... 126/299 D
4,154,861 A 5/1979 Smith ..... 426/466
4,231,769 A 11/1980 Ahlrich ..... 96/229
4,338,911 A 7/1982 Smith ..... 126/214
4,462,383 A * 7/1984 Henke et al. ..... 126/21 A
4,591,333 A * 5/1986 Henke ..... 432/10
4,626,661 A 12/1986 Henke ..... 219/400
4,665,806 A * 5/1987 Martin, Sr. ..... 454/299
4,701,340 A 10/1987 Bratton et al. ..... 426/511
4,834,063 A 5/1989 Huang et al. ..... 126/214
4,881,519 A * 11/1989 Henke ..... 126/21 A
4,887,522 A * 12/1989 Kuno et al. ..... 454/309
5,025,775 A 6/1991 Crisp ..... 126/21 A
5,131,841 A 7/1992 Smith et al. ..... 432/59
5,423,248 A 6/1995 Smith et al. ..... 99/443
5,454,295 A * 10/1995 Cox et al. ..... 99/332
5,480,281 A * 1/1996 Correia ..... 415/115
5,697,403 A * 12/1997 Onishi et al. ..... 138/37
5,746,047 A * 5/1998 Steyer et al. ..... 60/39.5

(Continued)

OTHER PUBLICATIONS

U.S. Appl. No. 07/662,270, filed Feb. 1991, Henke.

(Continued)

*Primary Examiner*—James F Hook
(74) *Attorney, Agent, or Firm*—Ohlandt, Greeley, Ruggiero & Perle, L.L.P

(57) ABSTRACT

An impinging air duct that comprises one or more ramps disposed within. The ramps direct air entering the duct through columnating orifices, and helps to provide an even flow of air out of the orifices, along the length of the duct. The angle of the ramp and the location of the ramp within the duct can be adjustable.

6 Claims, 10 Drawing Sheets

U.S. PATENT DOCUMENTS

| | | | | |
|---|---|---|---|---|
| 5,906,195 | A | 5/1999 | Georgaras | 126/299 D |
| 6,192,877 | B1 * | 2/2001 | Moshonas et al. | 126/21 A |
| 6,227,189 | B1 * | 5/2001 | Dougherty | 126/21 A |
| 6,526,961 | B1 | 3/2003 | Hardenburger | 126/21 A |
| 6,729,843 | B1 * | 5/2004 | Nichtawitz et al. | 415/211.2 |
| 6,817,283 | B2 * | 11/2004 | Jones et al. | 99/386 |
| 6,933,473 | B2 | 8/2005 | Henke et al. | 219/400 |
| 7,258,881 | B2 | 8/2007 | Jones et al. | 426/233 |
| 2005/0139203 | A1 | 6/2005 | Jones et al. | 126/21 A |
| 2008/0045136 | A1 * | 2/2008 | Huang | 454/237 |

OTHER PUBLICATIONS

U.S. Appl. No. 07/846,352, filed Mar. 6, 1992, Henke.
U.S. Appl. No. 07/662,270, filed Feb. 1991, Applicant: Henke.
U.S. Appl. No. 07/846,352, filed Mar. 6, 1992, Applicant: Henke.
International Search Report and Written Opinion dated Apr. 3, 2008 based on PCT application No. PCT/US07/19410.

* cited by examiner

AIR FLOW PATH FOR AN AIR IMPINGEMENT FINGER DUCT

CROSS-REFERENCE TO RELATED APPLICATIONS

The present disclosure claims priority to U.S. Provisional Application No. 60/842,244, filed on Sep. 5, 2006.

BACKGROUND OF THE DISCLOSURE

1. Field of the Disclosure

The present disclosure relates to a device for improving airflow inside an impinging air duct. More particularly, the present disclosure relates to a ramp channel that balances the air pressure along the length of the duct.

2. Description of the Related Art

In the field of impinging air ovens and other devices, an air duct is a tapered, horizontal airflow delivery device disposed above and/or below the cooking surface. The duct becomes dynamically pressurized and moves and directs airflow toward jet-forming orifices disposed in a columniating plate. These orifices then direct the airflow toward a cover plate with a second pattern of orifices or dispensing ducts. Such tapered ducts are well known in the field.

The size and shape of the ducts will have to conform to the general shape of the oven. In situations where a lower profile or reduced height oven is preferred, this presents a problem because it is more difficult to acquire a uniform velocity and/or mass flow of air along the length of the duct. For example, in shorter air dispensing ducts, the air has a tendency to gravitate to the front or end of the duct. This phenomenon can adversely affect uniformity of cooking and efficiency of the oven, as well as increase the energy costs of operating the oven.

Accordingly, there is a need for an impingement air duct and airflow pattern inside the duct that overcomes the disadvantages of currently available systems.

SUMMARY OF THE DISCLOSURE

The present disclosure serves these and other purposes with a multi-tapered ramp channel concept to force air mass flow to the columniating plate and cover plate in a substantially uniform manner, where low airflow pressures may otherwise have existed along the length of the duct. This is a corrective enhancement to the duct to significantly increase its airflow efficiency.

The ramps are formed as channels to guide the airflow through the length of the duct. The air entering the duct that interacts with the ramp channel is directed to the columniating and cover plates, as opposed to flowing directly to the end of the duct, while the rest of the air entering the duct passes along its normal course. This direction change is what improves the airflow volume and pressure out of the dispensing orifices in the cover plate, in an area that would typically exhibit lowered pressure without the enhancements of the present disclosure.

Thus, in one embodiment, an impinging air duct of the present disclosure comprises an opening at one end of the air duct, wherein an air flow enters the air duct through the opening, an outer shell, a columnating plate connected to the outer shell, which comprises a plurality of orifices disposed thereon, and a ramp connected to the outer shell, wherein the ramp partially directs the air flow through the orifices of the columnating plate.

DETAILED DESCRIPTION OF THE DISCLOSURE

Figure 1:
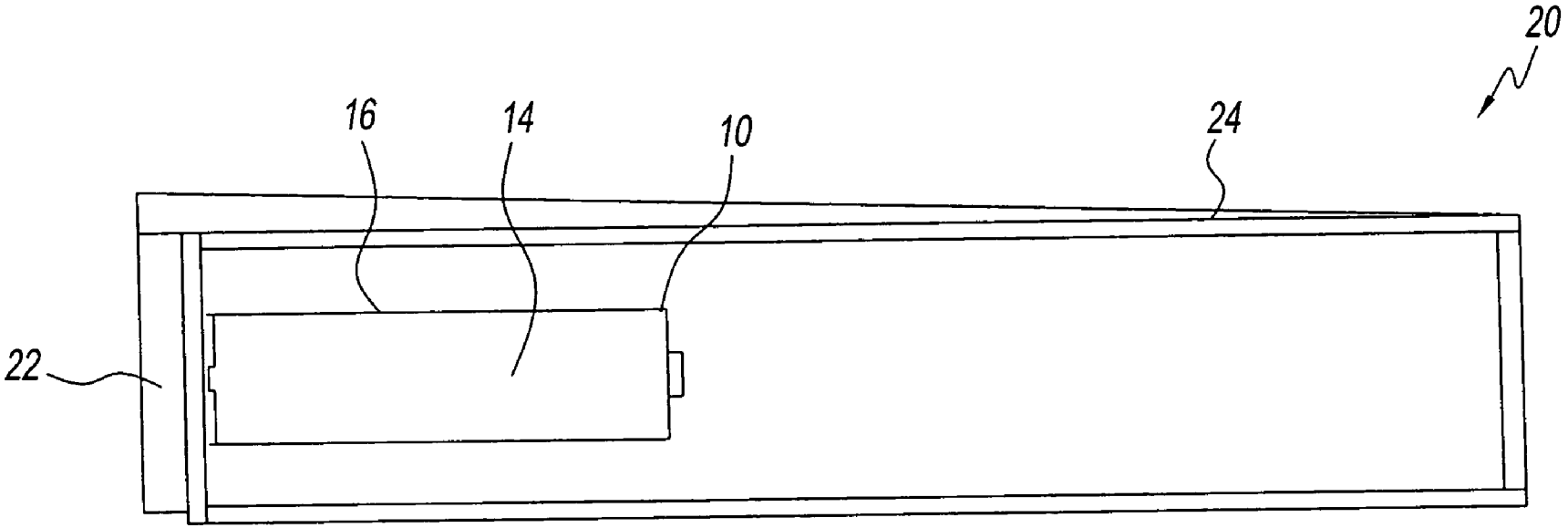
FIG. 1 is a top view of an air dispensing duct including the ramp channel of the present disclosure.
Figure 2:
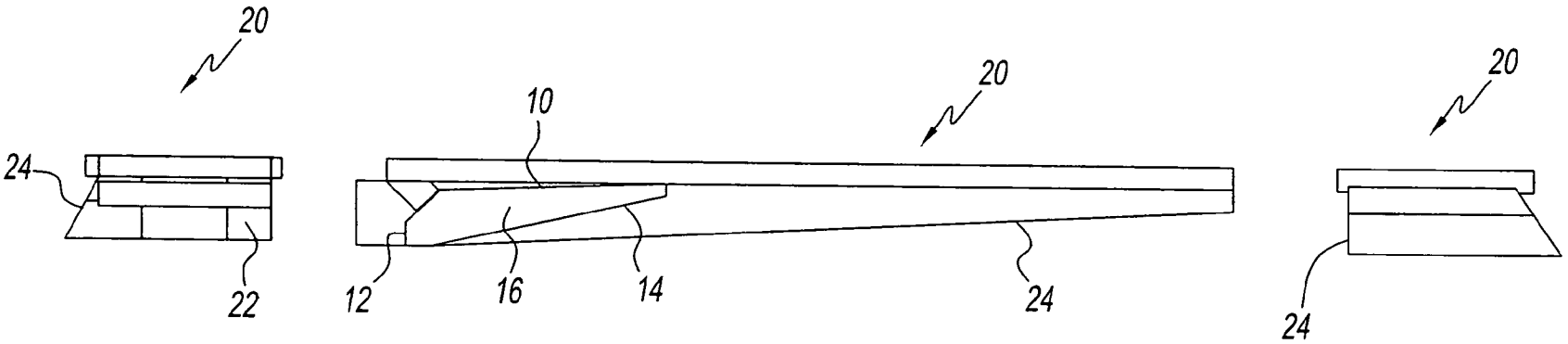
FIG. 2 shows a rear, a side cross-sectional view, and a front view of the duct of FIG. 1.
Figure 3:
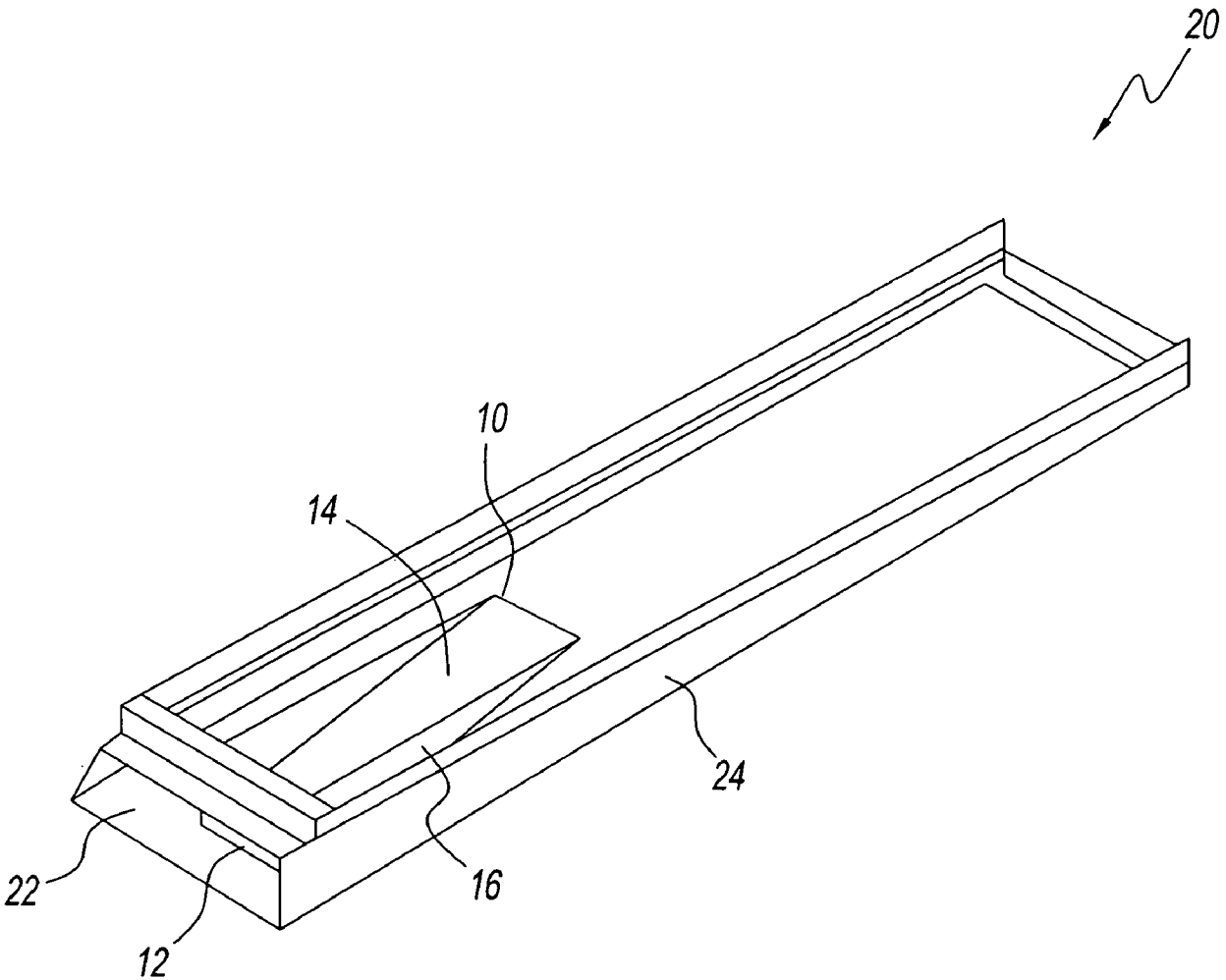
FIG. 3 is a front perspective view of the duct of FIG. 1.
Figure 4:
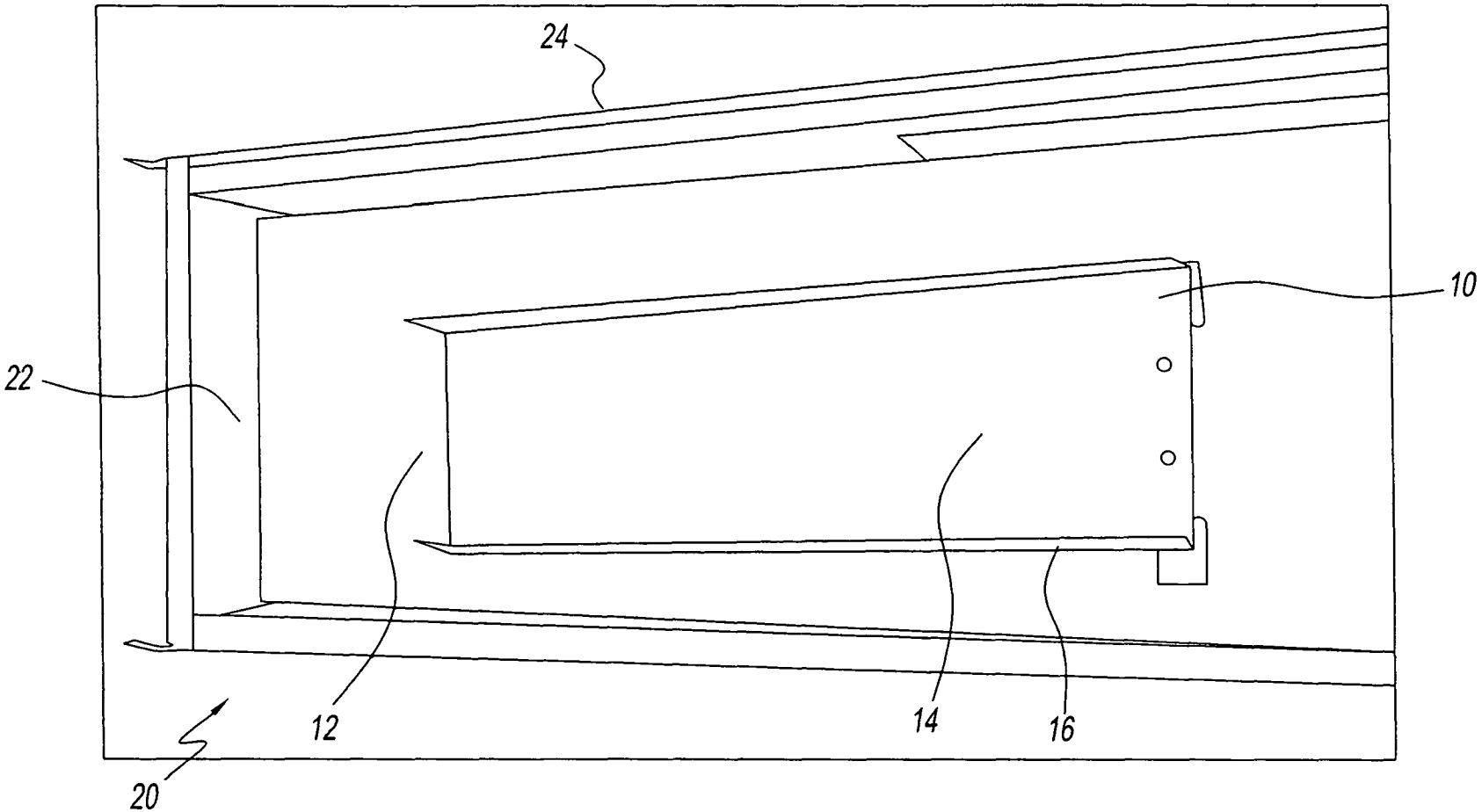
FIG. 4 is a second top view of an air dispensing duct including the ramp channel of the present disclosure.
Figure 5:
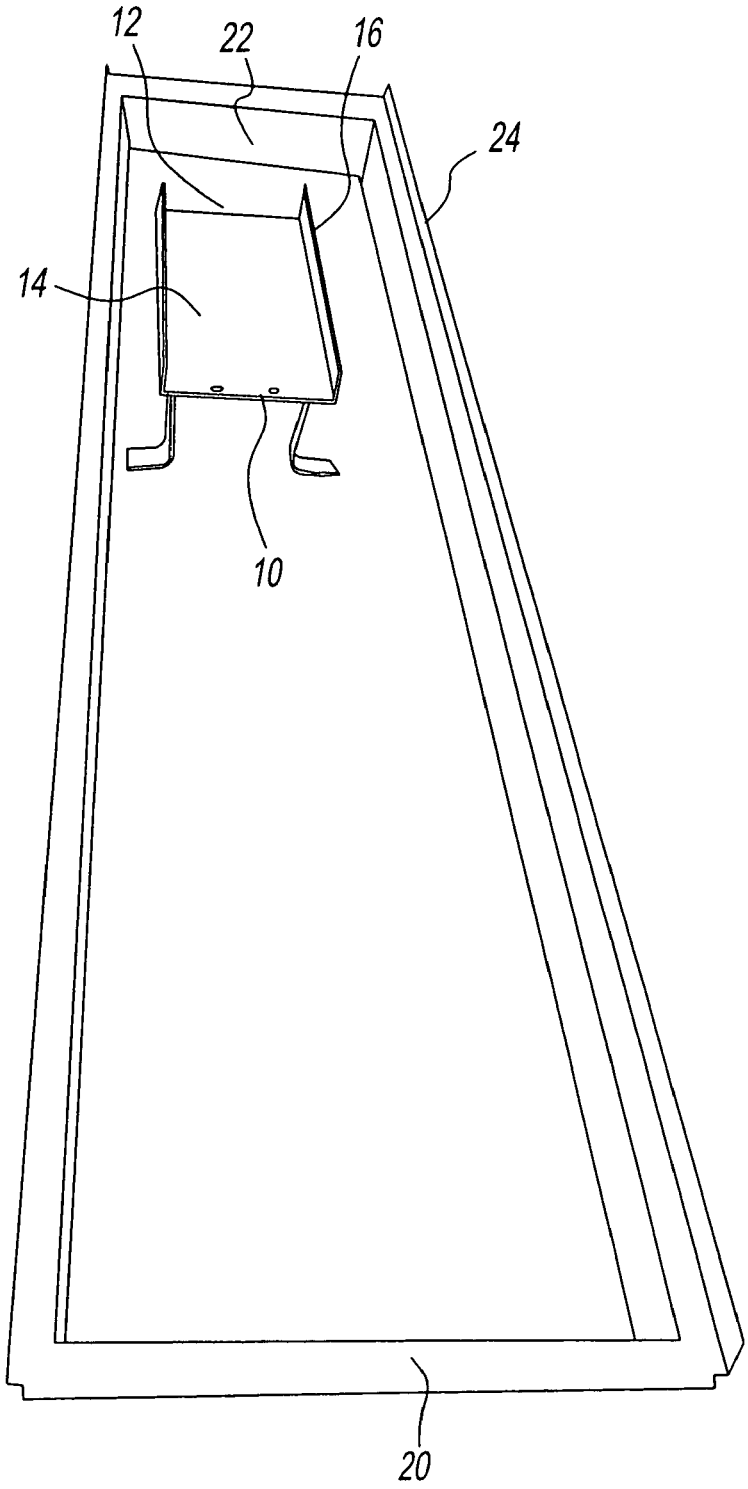
FIG. 5 is a third top view of an air dispensing duct including the ramp channel of the present disclosure.
Figure 6:
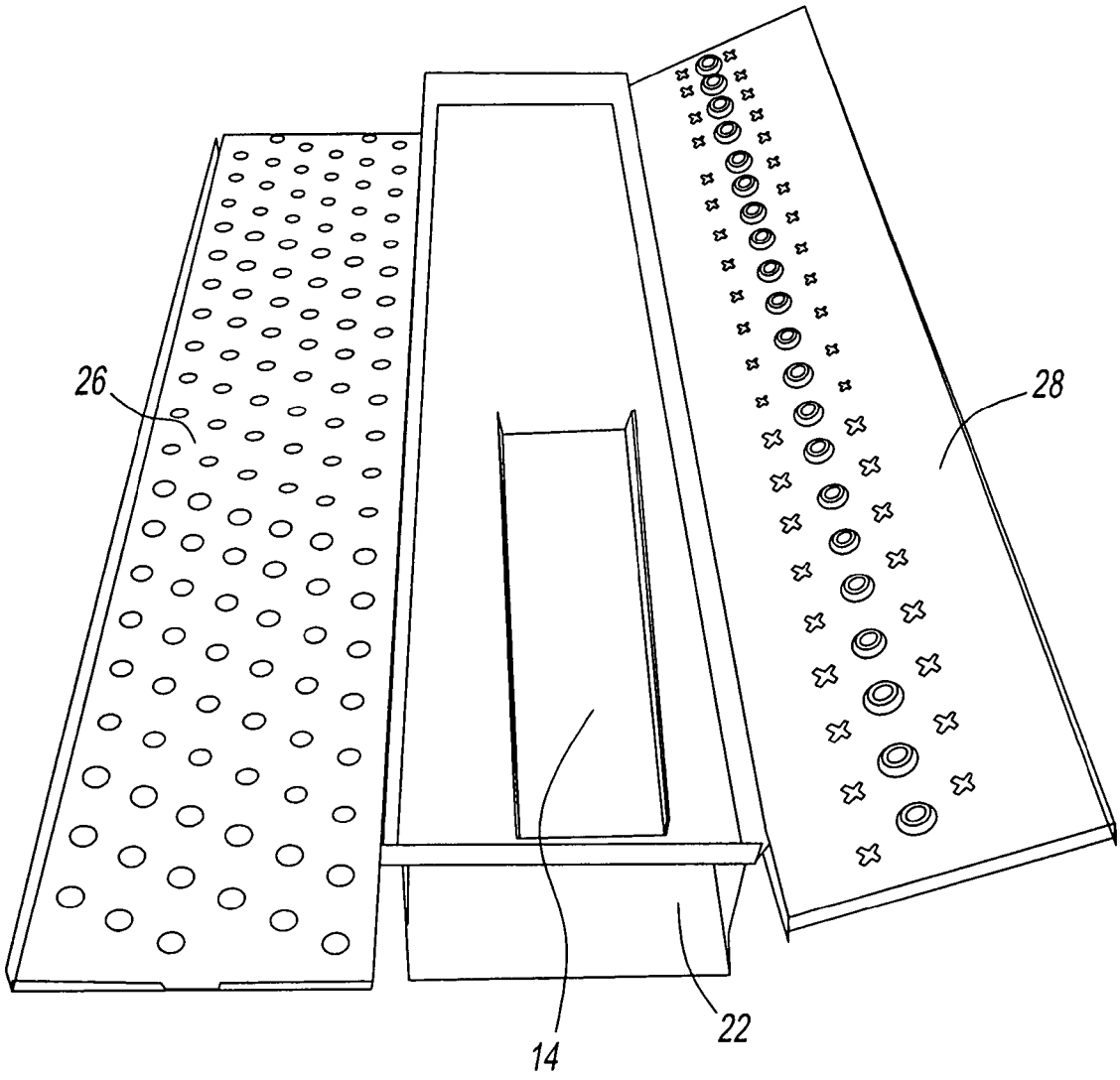
FIG. 6 is a fourth top view of an air dispensing duct, including the ramp channel of the present disclosure, a columniating plate, and a cover plate.
Figure 7:
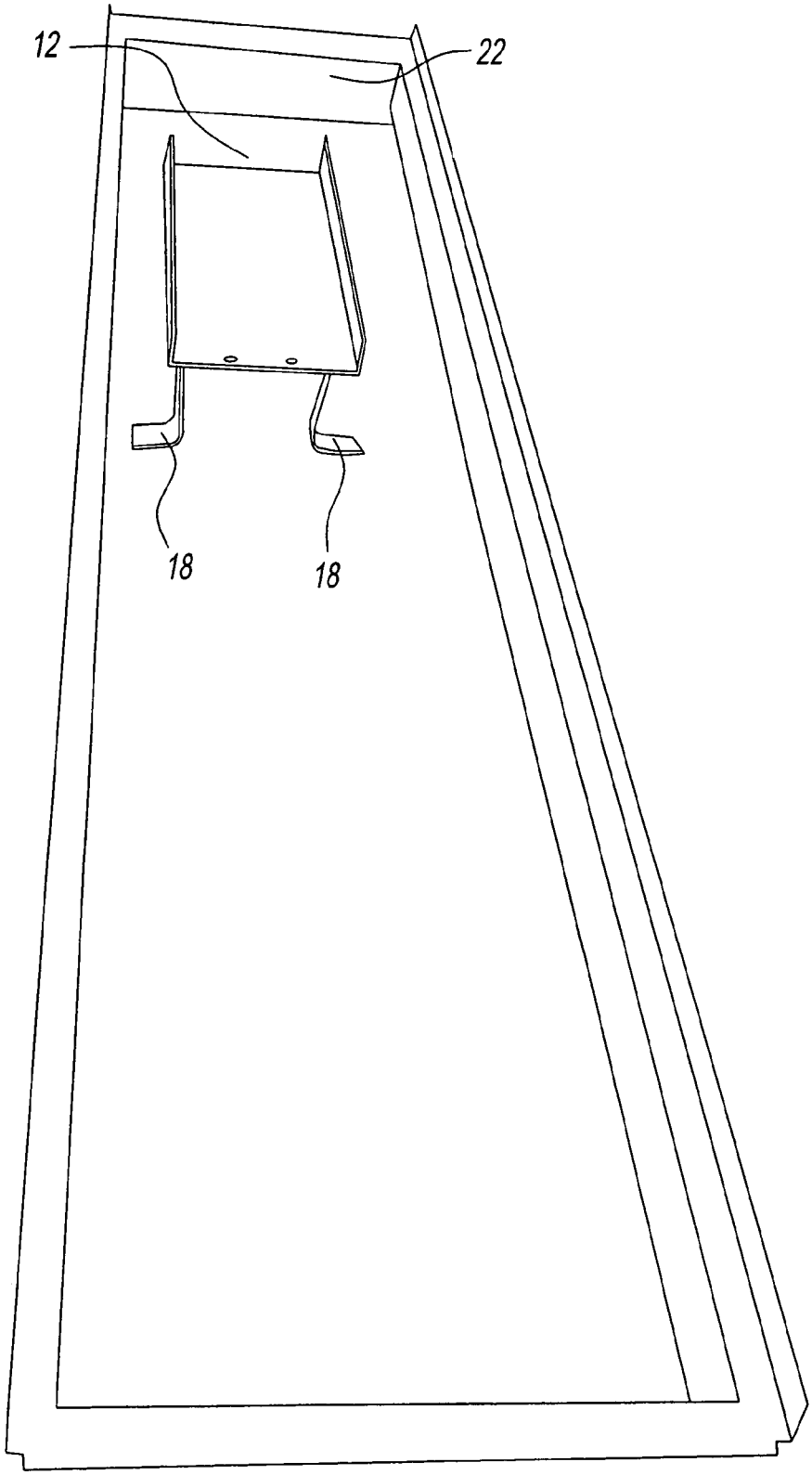
FIG. 7 is a fifth top view of an air dispensing duct including the ramp channel of the present disclosure and a cover plate.
Figure 8:
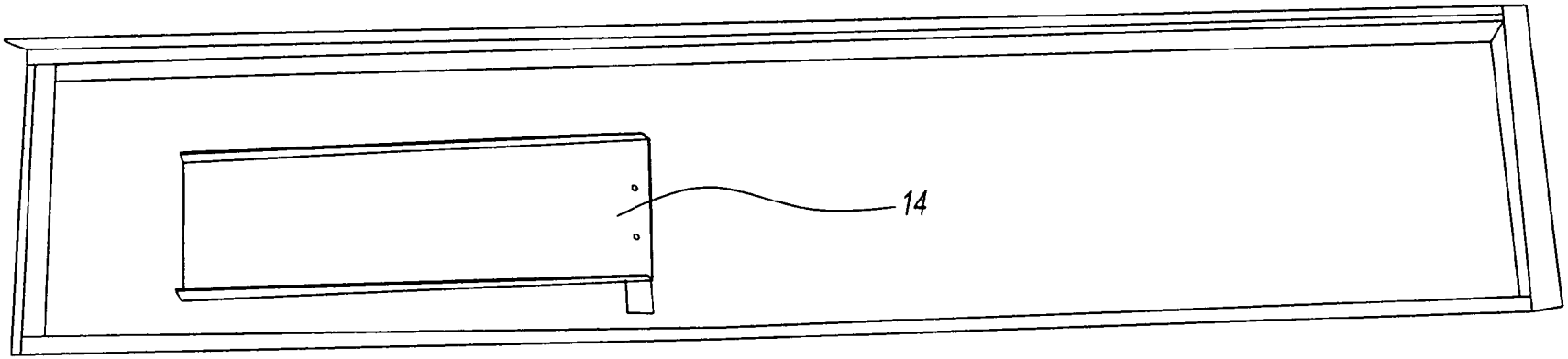
FIG. 8 is a sixth top view of an air dispensing duct including the ramp channel of the present disclosure and a cover plate.

The present disclosure provides a significant improvement over currently available devices in terms of cooking uniformity and heat transfer over the entire cooking surface. By enhancing the velocity and mass flow of air along the length of the duct, the ramp channel of the present disclosure ensures that the disparities in cooking uniformity along the cooking surface are minimized, if not completely eliminated. This improved airflow design also helps to increase the energy efficiency of the oven, which saves significantly on the energy costs associated with currently available models.

The ramp channel of the present disclosure is multi-tapered so that air entering the duct is redirected toward the columniating plate and cover plate of the dispensing duct. The ramp channel can be placed at a position along the length of the duct that would otherwise experience lower air pressure. Thus, air or mass flow entering the duct which would normally move to the end of the duct and cause an imbalance in air pressure along the duct is redirected, which improves the overall efficiency of the dispensing duct.

Referring to FIGS. 1 through 8, the ramp channel 10 of the present disclosure disposed within an air dispensing duct 20 is shown. Air dispensing duct 20 has opening 22 and shell 24. Air dispensing duct 20 also has columniating plate 26 and cover plate 28, which would be placed over dispensing duct 10 during operation. Shell 24 is a three-sided structure that runs the length of duct 20 and forms a pocket, within which ramp channel 10 is disposed. Ramp channel 10 comprises a channel opening 12, ramp 14, and sidewalls 16, so that a ramp with a shape that generally conforms to the shape of duct 20 is formed.

Figure 9:
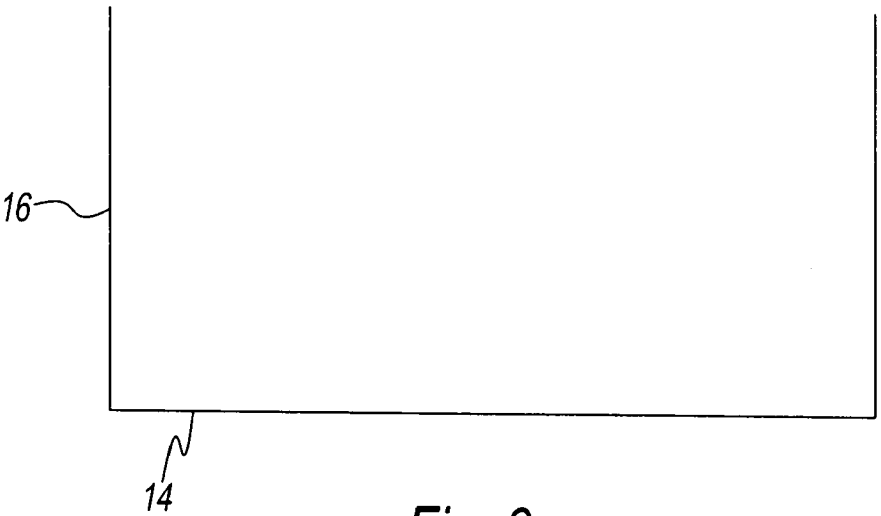
FIG. 9 is a diagram of a first alternate shape for the side walls of the ramp channel of the present disclosure.
Figure 10:
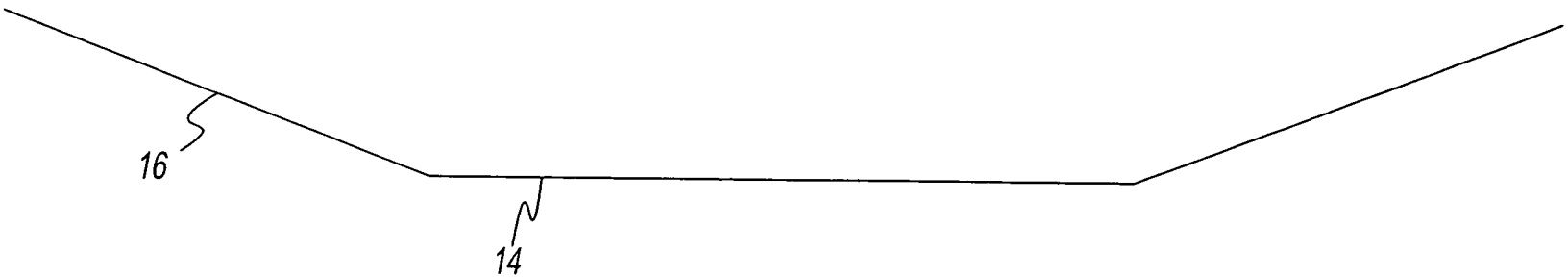
FIG. 10 is a diagram of a second alternate shape for the side walls of the ramp channel of the present disclosure.

Ramp channel 10 is multi-tapered, meaning that there are two sidewalls 16, disposed on either side of the ramp 14. Sidewalls 16 help to ensure that air entering ramp channel 10 stays within the channel. As is shown in FIGS. 9 and 10, sidewalls 16 can be disposed at a number of angles to ramp 14, including the 90 and 30 degree angles shown.

Thus, when air enters duct 20 through opening 22, some of it passes between shell 24 of duct 20 and ramp channel 10, and moves on to the end of duct 10. Some of the airflow enters ramp channel 10 through channel opening 12, and is redirected toward columniating plate 26 and cover plate 28. As discussed above, this helps to ensure that the air pressure is substantially even along the length of dispensing duct. Ramp channel 10 can be connected to dispensing duct 20 with a pair of mounting brackets 18. Mounting brackets 18 can be mounted to ramp 14 and shell 24 by any number of methods, such as with welding, spot welding, fusing, or with fasteners, clips, tabs, or rivets.

The ramp channel 10 can be made of a number of different kinds of materials, including any kind of steel, aluminum, plastic, ceramic, or composite material. Ramp channel 10 can also be molded for low temperature applications.

Additionally, in the shown embodiment, there is one ramp channel 10 disposed within the dispensing duct 20, but the present disclosure contemplates the use of one or more ramp channels 10 disposed along the length of dispensing duct 20.

In the shown embodiment, ramp channel 10 is disposed slightly off center within dispensing duct 20, and off to one side. Ramp channel 10, however, can be disposed anywhere along the width of dispensing duct 20, including centered between the walls of shell 24 or up against one of the walls of shell 24. Additionally, ramp channel 10 may be disposed anywhere along the length of dispensing duct 20, from the base near opening 22, or near the end. Furthermore, the angle and distance at which ramp channel 10 is disposed with respect to shell 24 of dispensing duct 20 can be altered. The optimal values of these parameters will all depend on the particular airflow characteristics of the dispensing duct. In one embodiment of the present disclosure, the location and orientation of the ramp channel 10 can be adjusted by a user through the use of manual controls located on the dispensing duct.

Figure 11:
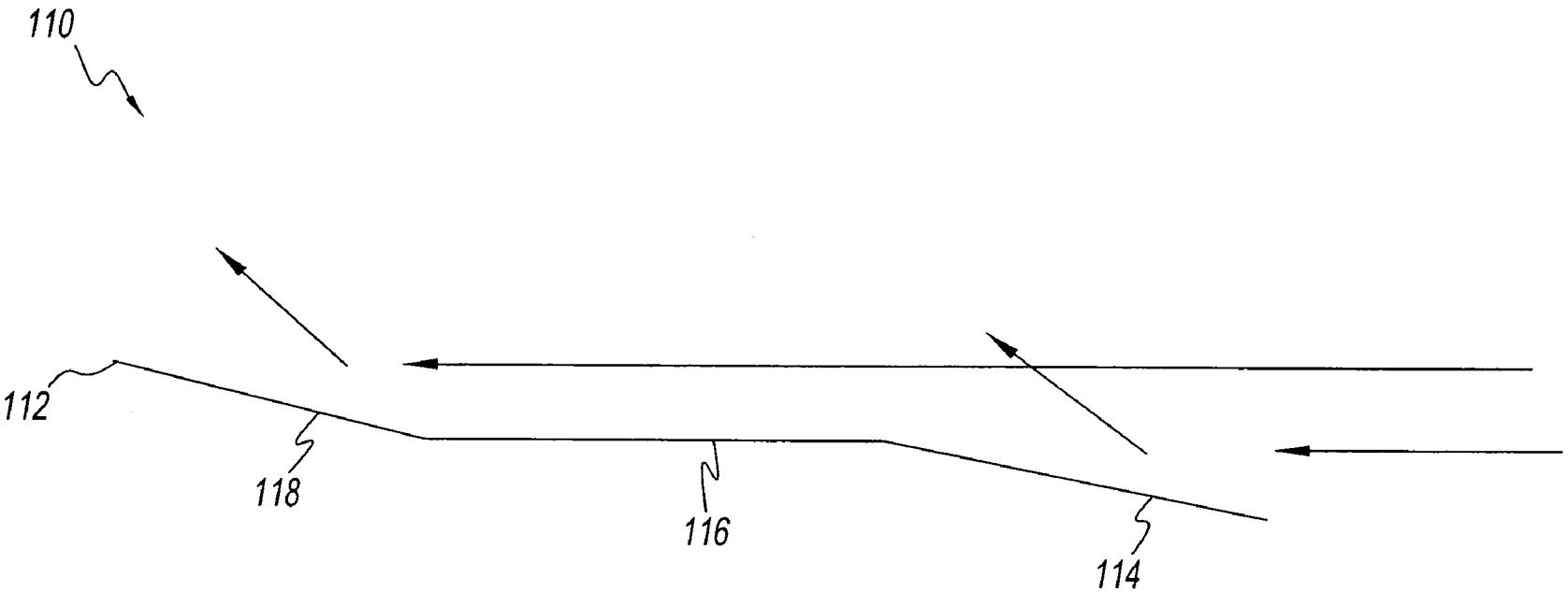
FIG. 11 is a diagram of an alternate shape for the ramp of the ramp channel of the present disclosure.

Referring to FIG. 11, a profile of a second embodiment of the ramp channel of the present disclosure is shown. Ramp channel 110 is similar to ramp channel 10, and can have all of the features associated with ramp channel 10, with the exception that ramp channel 110 has a multi-angular shape. This multi-angular shape can be configured to suit the particular needs of the application. For example, in the shown embodiment, ramp channel 10 has ramp 112, which further has first section 114, second section 116, and third section 118. First section 114 and third section 118 are angled so that they would generally conform to the slope of an air dispensing duct. Second section 116 can be flat or horizontal. Thus, ramp 112 can alter the flow of air entering ramp channel 110 in two places, namely at the junction of first section 114 and second section 116, and at the junction of second section 116 and third section 118. Although in the shown embodiment ramp channel 110 has three sections 114, 116, and 118, the present disclosure contemplates the use of two or more ramp sections, depending on the particular needs of the application.

The ramp channels of the present disclosure may also be used in other applications, other than inside an air dispensing duct of an oven. The ramp channels of the present disclosure can also be used in any other application where it would be advantageous to redirect air flow, or in any number of cooling or heating applications.

The present disclosure having been thus described with particular reference to the preferred forms thereof, it will be obvious that various changes and modifications may be made therein without departing from the spirit and scope of the present disclosure as defined in the appended claims.

What is claimed is:

1. An impinging air duct, comprising:

an opening at one end of the air duct, wherein an air flow enters the air duct through said opening, an outer shell comprising three sides that run the length of the impinging air duct, wherein two of said three sides are two sidewalls that are perpendicular to a third of said three sides, a columnating plate connected to said outer shell, and comprising a plurality of orifices disposed thereon, a cover plate over said columnating plate comprising a plurality of cover plate orifices thereon, and a multi-tapered ramp channel connected to said outer shell so that it is within a pocket formed by said three sides of said outer shell, and there is a gap between said multi-tapered ramp channel and said side walls, wherein said multi-tapered ramp channel comprises a ramp and two ramp sidewalls connected to said ramp, wherein said multi-tapered ramp channel partially directs said air flow through said orifices of said columnating plate, and wherein said air flow that is partially directed through said orifices of said columnating plate by said ramp channel passes through said plurality of cover plate orifices on said cover plate.

2. The impinging air duct of claim 1, wherein an angle between said ramp channel and said outer shell is adjustable.

3. The impinging air duct of claim 1, wherein a distance between said ramp channel and said opening is adjustable.

4. The impinging air duct of claim 1, wherein said gap between said ramp channel and sidewalls of said outer shell is adjustable.

5. The impinging air duct of claim 1, wherein said ramp has a plurality of angled portions.

6. The impinging air duct of claim 1, wherein said sidewalls of said multi-tapered ramp channel are at ninety-degree angles to said ramp.

* * * * *